United States Patent [19]

Swartz et al.

[11] Patent Number: 4,522,398

[45] Date of Patent: Jun. 11, 1985

[54] POLICE BATON

[76] Inventors: Franklin J. Swartz, 89 State St., 9th Floor, Boston, Mass. 02109; Alex Anatolev, 645 Beacon St., Boston, Mass. 02215

[21] Appl. No.: 463,966

[22] Filed: Feb. 4, 1983

[51] Int. Cl.[3] ..... F41B 15/02

[52] U.S. Cl. ..... 273/84 R; 84/477 B

[58] Field of Search ..... D22/1, 99; 273/84, 67 R; 272/124, 122; 46/47; 84/477 B

[56] References Cited

U.S. PATENT DOCUMENTS

| | | | |
|---|---|---|---|
| 46,413 | 2/1865 | Windshin | 272/122 |
| D. 137,451 | 3/1944 | Harstad | D21/1 |
| 281,097 | 7/1883 | McGinnis | 272/124 X |
| 450,258 | 4/1891 | Schwend | 273/84 |
| 3,608,899 | 9/1971 | Hall | 273/84 A |
| 3,944,226 | 3/1976 | Starrett | 273/84 R |
| 4,283,051 | 8/1981 | Perez | 273/84 R |
| 4,455,023 | 6/1984 | Saloom | 273/84 R |

FOREIGN PATENT DOCUMENTS

| | | | |
|---|---|---|---|
| 5272 | of 1890 | United Kingdom | 272/124 |
| 2333 | of 1906 | United Kingdom | 272/122 |

*Primary Examiner*—George J. Marlo

*Attorney, Agent, or Firm*—Wolf, Greenfield & Sacks

[57] ABSTRACT

A police baton is disclosed which is designed to be gripped in the center. The center gripping section comprises approximately one third the length of the baton with one third of the baton extending on either side of the operator's hand when the baton is in use. The gripping portion is comprised of a pair of double tapered sections which cause the shaft to neck to a waist in both directions from the center. The baton is designed to be used with a flicking wrist motion which allows effective strikes with a short trajectory and the contoured center gripping section maximizes the effect of the flicking wrist motion.

4 Claims, 1 Drawing Figure

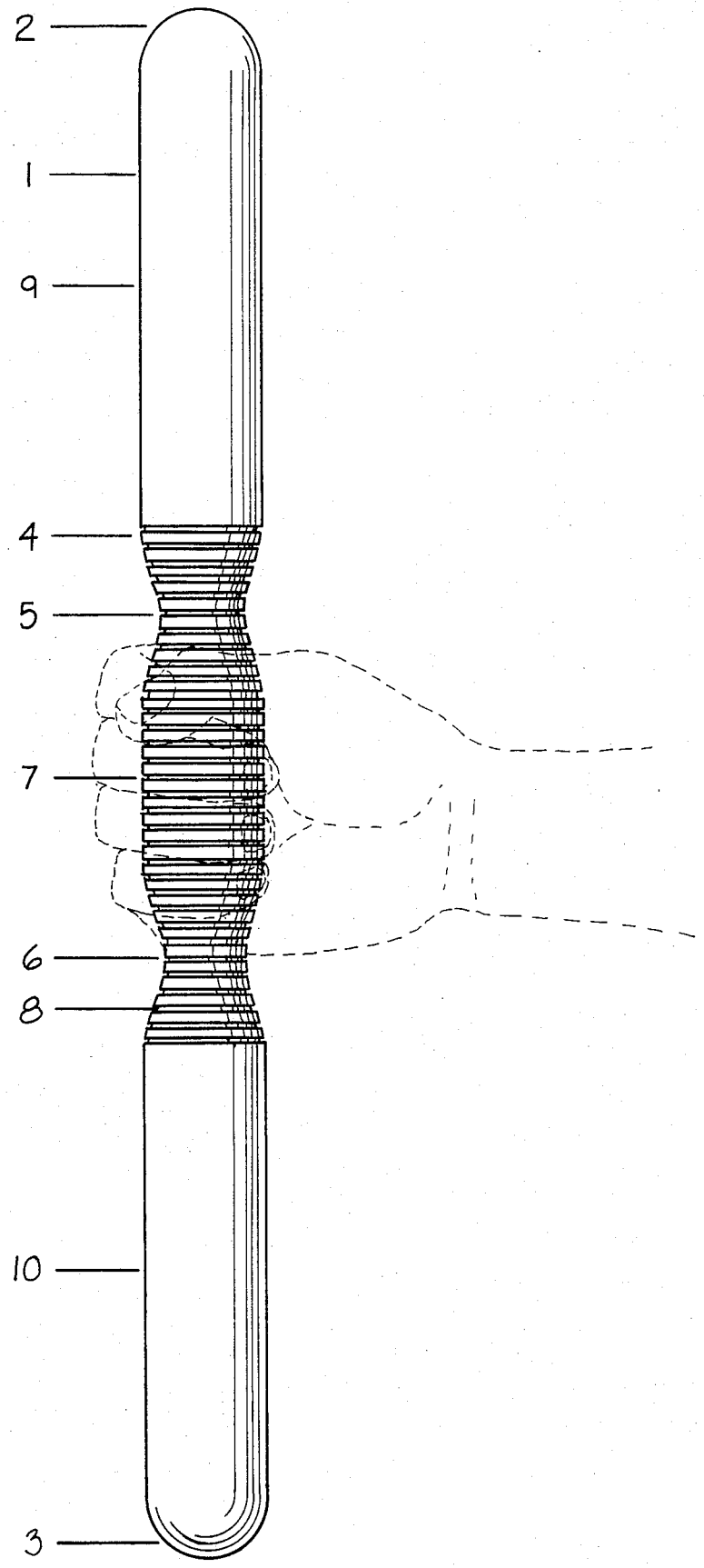
2
1
9
4
5
7
6
8
10
3

POLICE BATON

FIELD OF INVENTION

Our invention relates to police weapons and more particularly to a new and useful baton for the use of police and other peace officers in maintaining law and order and for self defense.

BACKGROUND OF THE INVENTION

Heretofore the standard cylindrical police baton has been an effective tool in the hands of police and other peace officers. This has been the 3.4 centimeter (cm.) diameter by 60 cm. model weighing somewhat less than a kilogram. The said police baton is designed to be grasped at one end and swung or thrust at an attacker. Police officers are also taught other baton techniques which are intended to aid in subduing a recalcitrant suspect.

Recently modified batons with fixed or rotatable side handles have been developed. These side handle batons measure approximately 61.53 cm. along the main shaft which is approximately 3.2 cm. in diameter. At a point approximately 15.38 cm. from one end of the main shaft is affixed, perpendicularly, a handle approximately 14.10 cm. in length. The handle is referred to as a "Yawarra" handle by those skilled in the martial arts. The Yawarra handle is either fixed or rotates as a sleeve about a longitudinal axis which is perpendicular to the main shaft. In both embodiments of the side handle baton the baton is grasped by the side handle which extends upwards to the main shaft and the baton is swung back and forth in a sweeping motion along a horizontal plane.

A weakness of both the standard cylindrical baton and of the side handle batons is that they both require considerable space in which to be effectively used. Both the standard cylindrical baton and the side handle batons are likely to cause severe injuries to the subject, even when such injuries are not warranted. Both the standard cylindrical baton and the side handle batons are most effective when the individual using the baton is confronted head on. Attacks from the side and from the rear are difficult to counter with both the conventional cylindrical baton and the side handle baton. Additionally, both the standard cylindrical baton and the side handle batons are difficult to use in opposition to group attacks. As a consequence of these limitations, both the standard cylindrical baton and the side handle batons are apt to be used aggressively rather than defensively. Because of the size and the manner in which they are grasped, both the standard cylindrical baton and side handle batons are highly visible to the potential assailants and to bystanders. In some situations the high visibility of both the standard cylindrical baton and the side handle batons may increase the potential for physical confrontation between the officer and an excitable suspect.

The standard cylindrical baton, because it is grasped by its end may result in impact trauma to the operator's wrist when the baton is used in a swinging motion to strike a solid object. When used to block an attack with a long weapon, such as an axe handle or tire iron, or an opponent's blow, the standard cylindrical baton does not provide adequate protection, the use of it for defense in such situations may result in injury to the operator's hands and limbs.

Side handle batons require considerable training time to acquire the skill needed for proficient operation. This drawback has tended to limit the use of the side handle batons because of the investment which is required in training to assure the effectiveness and safeness of the weapon's use. Because of the usual length of the side handle batons, when the baton is grasped in the standard ready position, approximately 46.15 cm. of the main shaft extends along the outer side of the operator's forearm and past the elbow. When the arm holding the baton in this manner is raised to defend against a downward blow from a long weapon, the impact may be transferred to the operator's elbow, resulting in injury.

OBJECTS

Accordingly, it is an object of our invention to provide a police baton which is suitable for rapid blocking and striking techniques.

It is another object of our invention to provide a police baton which is so designed as to discourage strikes to the head of the attacker.

It is another object of our invention to provide a police baton which is grasped at its center point.

It is another object of our invention to provide a police baton which is used with a flicking wrist motion.

It is another object of our invention to provide a police baton which is intended to deliver blows to muscle groups, rather than bones and joints, thus causing temporary muscular paralysis.

It is another object of our invention to provide a baton which can be used in close quarters, no wider than the body width of the person using the police baton.

It is another object of our invention to provide a police baton which can be used to defend against group attack.

It is another object of our invention to provide a police baton which can be used to defend against attacks from the sides and the rear.

It is another object of our invention to provide a police baton which can be used to defend against attempts to remove the officer's side arm against his or her will.

It is another object of our invention to provide a police baton, the center gripping portion of which may be used for the application of restraint and control holds.

It is another object of our invention to provide a police baton which is anatomically designed for the deflection of punches, kicks, and attacks from long weapons such as clubs and tire irons.

It is another object of our invention to provide a police baton which is inoffensive in appearance when held in the hand ready for use.

It is another object of our invention to provide a police baton which reduces the stress absorbed by the user's wrist when making a strike or thrust.

It is another object of our invention to provide a baton which may be effectively and safely used after a brief period of training.

It is another object of our invention to provide a police baton which may be used by police and other peace officers trained in Nuang-Fu, a Chinese form of self defense.

Other objects of our invention will be apparent or will be specifically pointed out in the description forming a part of this specification, but we do not limit ourselves to the embodiment of the invention herein described, as various forms may be adopted within the scope of the claims.

SUMMARY OF THE INVENTION

Briefly stated, the preferred embodiment of this invention comprises a police baton having a tapered centered gripping portion. The center gripping portion comprises a double tapered section which begins at its largest diameter in the exact center of the police baton and narrows and then increases to the diameter of the shaft in both directions. The gripping portion of the police baton is approximately one-third of the police baton's length. The police baton is, therefore, adapted to be gripped in the center, and flicked with a wrist motion to block or strike. The police baton is of suitable length so that its ends protrude far enough from the gripping hand that it can be used for blocking, striking, and the deflection of blows. The gripping portion may also be applied to the suspect's limbs for the execution of restraint and control techniques.

BRIEF DESCRIPTION OF THE DRAWING

The FIGURE is a side view of one preferred form of our invention, being illustrated with the operator's hand in outline.

DESCRIPTION OF A PREFERRED EMBODIMENT.

Our invention may be more fully understood by direct reference to the illustration of a preferred form:

We prefer to make the body of the police baton unitary and therefore it may be made of wood, metal, plastics or other compositions that would be readily apparent to those skilled in the art.

The police baton is composed of a shaft (1) which is preferably 41 cm. in length and 3.2 cm. in diameter. The shaft of the police baton is of any geometric cross-section but is illustrated as round. A gripping portion (4) is comprised of a double tapered section (5)(6) which is at its largest diameter at the exact center (7) of the shaft and narrows and then increases to the diameter of the shaft in both directions. The double tapered sections cause the baton shaft 1 to neck down to a pair of waists (at locations 5 and 6). The waists are located symmetrically around the baton center 7. The contoured centered gripping portion maximizes the flicking wrist motion which allows effective strikes with a short trajectory. The contour of the center gripping portion also allows the center gripping portion to be used to apply pressure to a suspect's wrist when using the police baton to execute wrist lock techniques preparatory to escort and handcuffing procedures. The center gripping portion is preferably provided with axially extended depressions or flutes (8) to provide an easily gripped surface. The easily gripped surface of the center gripping portion is provided to prevent the police baton from slipping in the hand when the police baton is used to strike a blow. The center gripping portion of the police baton is approximately one-third of the police baton's length. The ends of the shaft of the police baton (9)(10) extend approximately 13.6 cm. from the center gripping portion. Each end is terminated, preferably, with a rounded striking surface (2)(3).

In use the police baton is carried in the hand with the fist clenched around the center gripping portion (4). The contour of the center gripping portion (5)(6)(7) allows the operator to place thumb of the fist over the first and second fingers of the fist thus locking the grasp. With the operator's arms at his or her sides one end of the police baton's shaft (9) or (10) (9 will be designated for purposes of illustration) rests along the underside of the forearm. The center gripping portion is concealed in the operator's fist. Thus two-thirds of the police baton is concealed. In order to strike with the police baton the operator briskly bends his or her elbow while making a brisk upward flicking motion with his or her wrist. As the police baton is raised the end (9 for illustration) which has been resting along the underside of the forearm is brought forward and out to strike the attacker. The rounded striking surface (2) (for the purpose of illustration) may also be used to jab or apply sliding pressure across the attacker's chest. From the raised position, with the operator's elbow at his or her side and the police baton being held at the operator's shoulder level, the operator's forearm is brought down and this motion is accompanied by a downward flicking motion of the wrist. As the operator's arm is lowered, the assailant can be jabbed with a stabbing motion of the rounded striking surface (2); struck with one of the ends of the police baton (10); or sliding pressure may be exerted with the other rounded striking surface (3). Because the ends (9)(10) of the police baton extend approximately 13.6 cm. from either side of the operator's hand, follow-up strikes are easily made even if there is an initial miss. The extended ends also allow the operator to jab and strike attackers who approach from behind or from the sides. The ends of the police baton (9)(10) can also be used for deflecting blows from long weapons, such as a club or a tire iron, by extending the arm holding the police baton and deflecting the long weapon along the portion of the end of the police baton (9) (9 is used for the sake of illustration) which is resting along the underside of the operator's forearm. The rounded striking surfaces (2)(3) can be used to press against pressure points such as bone edge surfaces and nerve centers. In the hands of an operator with training in Akido, Judo, or Nuang-Fu the center gripping portion (4) may be used in combination with the operator's thumbs to apply a wrist lock to a suspect.

While the above description contains many specificities, these should not be construed as limitations on the scope of the invention. Further, since numerous modifications will readily occur to those skilled in the art, it should be realized that structural changes could be made and other examples given without departing from either the spirit or scope of this invention. Accordingly, the scope of the invention should be determined not by the embodiment illustrated, but by the appended claims and their legal equivalents.

What we claim is:

1. A hand-held police baton comprising;
   - a shaft having a substantially constant outer diameter throughout its length except for;
   - a first double tapered section forming a first waist area in said shaft and
   - a second double tapered section forming a second waist area in said shaft, said waist areas being arranged symmetrically around the center of said shaft, the distance between said waist areas being adapted to accommodate the width of an operator's hand and being approximately equal to one-third the total length of the baton.

2. A hand-held police baton according to claim 1 wherein the ends of said shaft are rounded.

3. A hand-held police baton according to claim 2 wherein the section of said shaft between said waist areas is grooved to aid in gripping the shaft.

4. A hand-held polic baton according to claim 3 wherein said baton is made out of a plastic material.

* * * * *